US010945492B2

(12) United States Patent
Kim

(10) Patent No.: US 10,945,492 B2
(45) Date of Patent: Mar. 16, 2021

(54) SHOE LACE TIGHTENING DEVICE

(71) Applicant: Jung-gon Kim, Gyeongsangnam-do (KR)

(72) Inventor: Jung-gon Kim, Gyeongsangnam-do (KR)

( * ) Notice: Subject to any disclaimer, the term of this patent is extended or adjusted under 35 U.S.C. 154(b) by 0 days.

(21) Appl. No.: 16/499,278

(22) PCT Filed: Mar. 29, 2018

(86) PCT No.: PCT/KR2018/003690
§ 371 (c)(1),
(2) Date: Sep. 29, 2019

(87) PCT Pub. No.: WO2019/027122
PCT Pub. Date: Feb. 7, 2019

(65) Prior Publication Data

US 2021/0037926 A1 Feb. 11, 2021

(30) Foreign Application Priority Data

Aug. 4, 2017 (KR) ..... 10-2017-0099074

(51) Int. Cl.
*A43C 11/16* (2006.01)
*A43C 7/08* (2006.01)
*A43C 11/00* (2006.01)

(52) U.S. Cl.
CPC ..... *A43C 11/165* (2013.01); *A43C 7/08* (2013.01); *A43C 11/008* (2013.01)

(58) Field of Classification Search
CPC ..... A43C 11/165; A43C 7/08; A43C 11/008; A43C 11/16; Y10T 24/2183
See application file for complete search history.

(56) References Cited

U.S. PATENT DOCUMENTS

| | | | | |
|---|---|---|---|---|
| 7,954,204 | B2 | 6/2011 | Hammerslag et al. | |
| 10,070,695 | B2 * | 9/2018 | Burns | A61F 5/0118 |
| 10,076,160 | B2 * | 9/2018 | Burns | A43C 11/165 |
| 10,251,451 | B2 * | 4/2019 | Converse | A43C 11/12 |
| 10,258,109 | B2 * | 4/2019 | Midorikawa | A43B 23/02 |

(Continued)

FOREIGN PATENT DOCUMENTS

| | | | |
|---|---|---|---|
| KR | 10-2011-0110615 | A | 10/2011 |
| KR | 10-1147681 | B1 | 5/2012 |

(Continued)

*Primary Examiner* — Robert Sandy
*Assistant Examiner* — Louis A Mercado
(74) *Attorney, Agent, or Firm* — Bayramoglu Law Offices LLC

(57) ABSTRACT

A shoelace tightening device includes a main ratchet gear and an auxiliary ratchet gear, which allows a stopper unit to be coupled so as to have a clearance such that the stopper accurately engages with the main ratchet gear. The shoelace tightening device further includes: a lower cover having a receiving recess within a top portion of the lower cover; a reel rotatably inserted into the receiving recess of the lower cover, wherein the reel includes a gear coupling portion provided on a top portion of the reel such that a wire is wound on the reel when the reel is rotated; a housing accommodating the reel inside the housing, wherein a bottom end portion of the housing is fixed to the receiving recess of the lower cover to be integrally fixed to the lower cover.

4 Claims, 5 Drawing Sheets

(56) References Cited

U.S. PATENT DOCUMENTS

| | | | | |
|---|---|---|---|---|
| 10,285,472 | B2 * | 5/2019 | Wyatt | A43C 11/008 |
| 10,368,613 | B2 * | 8/2019 | Ha | A43C 11/165 |
| 10,470,525 | B2 * | 11/2019 | Chen | A43C 11/165 |
| 10,492,568 | B2 * | 12/2019 | Burns | F41C 33/0209 |
| 10,512,305 | B2 * | 12/2019 | Omarsson | A43C 11/165 |
| 10,543,630 | B2 * | 1/2020 | Hipwood | A43C 11/165 |
| 10,617,546 | B2 * | 4/2020 | Turrini | A61F 5/0111 |
| 10,660,404 | B2 * | 5/2020 | Chen | A43C 7/00 |
| 2018/0319617 | A1 * | 11/2018 | Kim | A45C 13/1046 |
| 2019/0144150 | A1 * | 5/2019 | Chen | A43C 11/165 100/32 |
| 2019/0150569 | A1 * | 5/2019 | Chen | A43C 11/165 |
| 2019/0200706 | A1 * | 7/2019 | Huang | A43C 11/165 |
| 2019/0343235 | A1 * | 11/2019 | So | A44B 11/12 |
| 2020/0069002 | A1 * | 3/2020 | Fiedler | A61F 5/01 |
| 2020/0128918 | A1 * | 4/2020 | Chen | A43C 7/08 |
| 2020/0128919 | A1 * | 4/2020 | Burt | E05C 3/122 |

FOREIGN PATENT DOCUMENTS

| | | | |
|---|---|---|---|
| KR | 10-1249420 | B1 | 4/2013 |
| KR | 10-1438572 | B1 | 9/2014 |
| KR | 10-1661236 | B1 | 9/2016 |
| KR | 10-2017-0010681 | A | 2/2017 |
| KR | 10-1833680 | B1 | 2/2018 |

* cited by examiner

SHOE LACE TIGHTENING DEVICE

CROSS REFERENCE TO THE RELATED APPLICATIONS

This application is the national phase entry of International Application No. PCT/KR2018/003690, filed on Mar. 29, 2018, which is based upon and claims priority to Korean Patent Application No. 10-2017-0099074, filed on Aug. 4, 2017, the entire contents of which are incorporated herein by reference.

TECHNICAL FIELD

The present invention relates to a shoelace tightening device allowing a wire-shaped shoelace fastening a mountain-climbing boot or a sneaker to be easily bound. More particularly, the present invention relates to a shoelace tightening device, in which subratchets are provided on a main ratchet and stoppers, which serve to prevent backward rotation when tightening a shoelace, to distribute operation load concentrated to the main ratchet, thereby preventing abrasion or damage of the main ratchet and improving the longevity of the main ratchet, and a space is provided to a stopper unit in a coupled position to allow the stoppers to be accurately meshed with the main ratchet, thereby preventing the shoelace from being unwound in a tightening process.

BACKGROUND

Recently, not only typical sneakers, but also sport shoes, such as mountain-climbing boots, running shoes, and golf shoes, are widely used along with increases in leisure activity. Such a shoe is provided with a shoelace wire tightening device for simply tightening and untightening a shoelace without binding the shoelace every time in order to provide convenience when wearing and taking off the shoe.

As disclosed in Korean Patent Nos. 10-1249420 ("WIRE TIGHTENING DEVICE") and 10-1438572 ("WIRE TIGHTENING DEVICE"), such a wire tightening device uses a ratchet allowing a stopper unit to restrain a bobbin on which a wire-shaped shoelace is wound. According to this configuration, the wire can be tightened by rotating a rotatable cover in one direction, whereas the bobbin is freely rotatable when the restraint of the stopper unit, except for the ratchet, is released, so that the shoelace can be unwound.

The related-art wire tightening device having the above-described configuration winds the wire on the reel by restraining the ratchet to be rotatable in one direction using a pawl of the stopper unit so that the ratchet does not rotate in the other direction. Consequently, restraining force is strongly concentrated to the ratchet. For example, when a user strongly tightens the shoelace or the shoelace is strongly drawn by a movement of the foot, strong unwinding force acts on the shoelace. Then, the force is concentrated to the pawl restraining the rotation of the ratchet, thereby applying strong stress to the ratchet. Damage, abrasion, or the like, may easily occur in the ratchet and the pawl. This may reduce the durability of the ratchet and the pawl, thereby reducing the longevity of the ratchet and the pawl, which is problematic.

In addition, the rotatable cover is rotated several times when tightening the shoelace of a mountain-climbing boot or a sneaker. When the rotatable cover is stopped after having been rotated, the stopper of the stopper unit rotating together with the rotatable cover may not be accurately engaged with a tooth of the ratchet. Then, the stopper may not be engaged with a tooth of the ratchet corresponding to a position at which the shoelace is intended to be tightened, but may be engaged with another tooth of the ratchet behind the intended tooth, so that the shoelace may be tightened by an amount of tightening force smaller than an intended amount of tightening force, which is problematic.

SUMMARY

Accordingly, the present invention has been made keeping in mind the above problems occurring in the prior art, and an object of the present invention is to provide a shoelace tightening device, in which subratchets are provided on the top surfaces of a main ratchet and a stopper unit, which serve to prevent backward rotation when tightening a shoelace, such that the subratchets are dual meshed in a position in which the shoelace is maintained in a wound position due to meshing between the main ratchet and stoppers. This configuration can assist in tightening force of the main ratchet and the stoppers, thereby intensifying restraining force, and distribute load concentrated to the main ratchet, thereby reducing abrasion and damage of the gears and increasing the longevity of the gears.

In addition, also provided is a shoelace tightening device, in which the stopper unit accommodated in a middle cover to control rotating force by meshing with the main ratchet is provided such that spaces are defined. In the case of tightening the shoelace, when the stoppers are in stopped positions after having been fitted into and exited the notches between the teeth of the main ratchet, the stoppers can be accurately meshed with the main ratchet in the stopped positions due to minute movement caused by the spaces. Accordingly, it is possible to prevent the stoppers from being pushed backwards in the process of tightening the shoelace, thereby obtaining an intended amount of tightening force.

In order to accomplish the above object, according to an aspect of the present invention, provided is a shoelace tightening device including: a lower cover having a receiving recess within a top portion thereof; a reel rotatably inserted into the receiving recess of the lower cover, and having a gear coupling portion provided on a top portion thereof such that a wire is wound on the reel when the reel is rotated; a housing accommodating the reel therein, with a bottom end portion thereof being fixed to the receiving recess of the lower cover to be integrally fixed thereto, the housing including a main ratchet provided along an inner circumferential portion of a top end portion thereof, a middle cover containing the housing therein while being separated from the housing so as to be rotatable, the middle cover including teeth circularly provided on an inner portion of a bottom surface thereof to be engaged with the gear coupling portion and a central shaft extending downward to be inserted into a central hole of the reel; a stopper unit accommodated within the middle cover, and having shaft holes in a bottom portion to be coupled to shafts of the middle cover, stoppers radially diverging from an outer surface to be elastic, and matching ratchets disposed on the stoppers to be engaged with the main ratchet of the housing, such that the main ratchet is restrained to rotate in one direction; and an upper rotatable cover covering a top surface of the middle cover, and rotating integrally with the middle cover due to locking members coupled to the middle cover, wherein a subratchet is circularly provided on an entire top surface of the main ratchet and rotates in the same direction as the main ratchet, horizontal plates are connected to top surfaces of the matching ratchets of the stoppers radially and elastically disposed on the stopper unit, and matching subratchets are disposed on bottom surfaces of the horizontal plates to be selectively engaged with the subratchet and rotate in the same direction as the subratchet, such that the matching subratchets are not engaged with the subratchet during rotation of the stopper unit and are engaged with the subratchet when stopped in a tightened position to provide dual restraining force.

In addition, the present invention is characterized in that the shaft holes of stopper unit, to which the shafts of the middle cover are coupled, are in a shape of slits such that spaces being defined between the shaft holes and the shafts, so that the stopper unit is movable slightly in a lateral direction.

In addition, the present invention is characterized in that the central shaft of the middle cover, inserted into the central hole of the reel to be moved up and down, has flexibility due to a notch formed in a middle portion thereof, and that locking protrusions are circularly provided on an outer circumferential portion of a bottom end of the central shaft, the locking protrusions being movable up and down while being brought into contact with and being detached from locking projections circularly provided on the central hole of the reel, so that indication of a connection and disconnection between the stopper unit and the reel is possible.

In addition, the present invention is characterized in that the lower cover has one or more sewing guide grooves provided along a peripheral portion thereof to guide accurate sewing.

According to the present invention, a dual meshing structure able to prevent backward rotation is provided by the main ratchet and the subratchets in order to intensity restraining force of tightening a shoelace and distribute load concentrated to the main ratchet, thereby preventing abrasion or damage of the gears and increasing the longevity of the gears.

In addition, the stopper unit can be accurately meshed with the ratchet by minute movement thereof caused by the spaces, so that an accurate amount of tightening force can be obtained at an intended position.

DETAILED DESCRIPTION OF THE EMBODIMENTS

Hereinafter, exemplary embodiments of the present invention will be described in detail with reference to the accompanying drawings.

Figure 1:
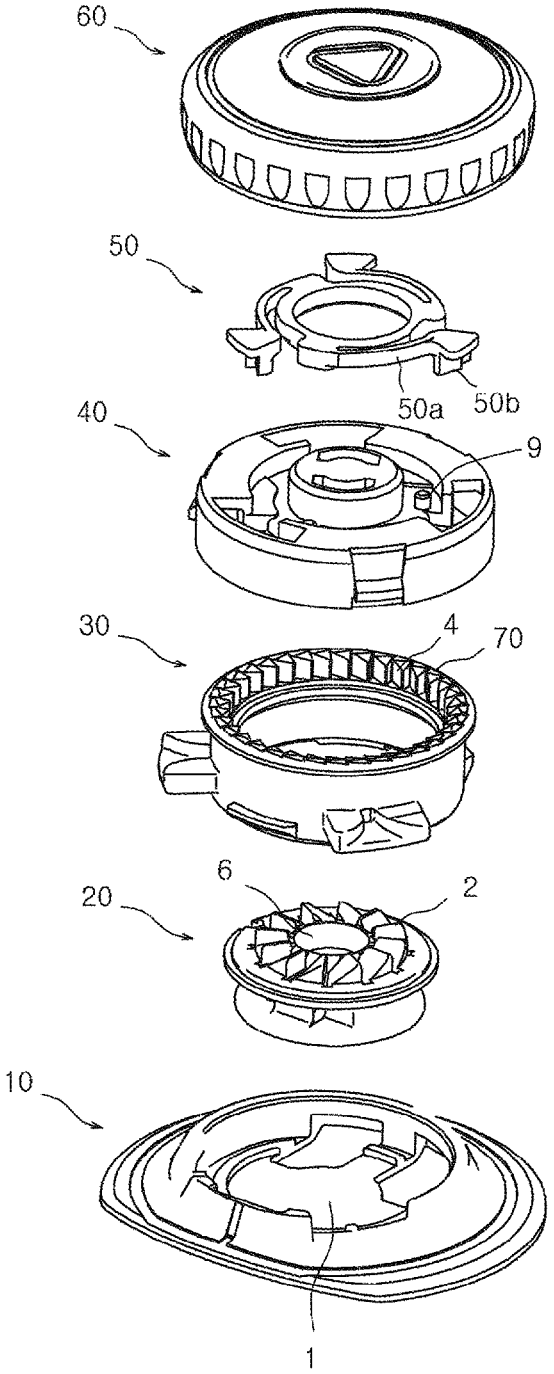
FIG. 1 is a top perspective view illustrating the present invention in an exploded state.
Figure 2:
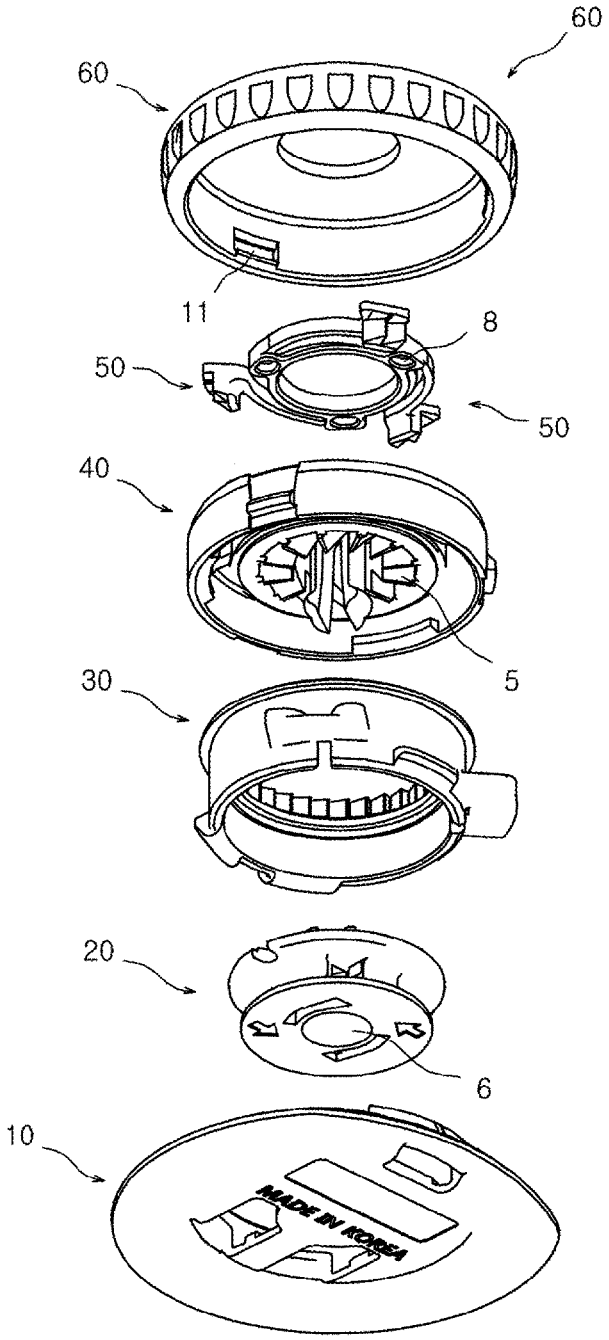
FIG. 2 is a bottom perspective view illustrating the present invention in an exploded state.
Figure 3:
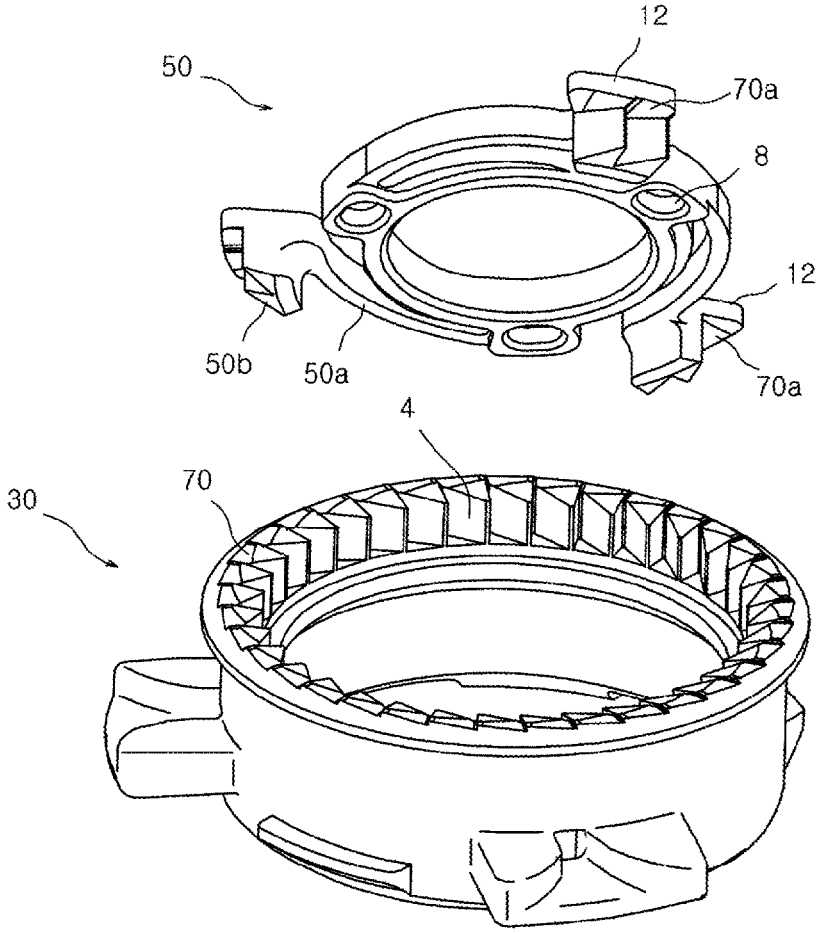
FIG. 3 is an exploded perspective view of the housing and the stopper unit.

As illustrated in FIGS. 1 and 2, the present invention provides a shoelace tightening device including a lower cover 10, a reel 20, a housing 30, a middle cover 40, a stopper unit 50, and an upper rotatable cover 60. The lower cover 10 has a receiving recess 1 within the top portion thereof. The reel 20 is rotatably inserted into the receiving recess 1 of the lower cover 10, and has a gear coupling portion 2 provided on the top portion thereof such that a wire 3 is wound on the reel 20 when the reel 20 is rotated. The housing 30 accommodates the reel 20 therein, with a bottom end portion thereof being fixed to the receiving recess 1 of the lower cover 10 to be integrally fixed thereto. The housing 30 has a main ratchet 4 provided along the inner circumferential portion of the top end portion thereof. The middle cover 40 contains the housing 30 therein while being separated from the housing 30 so as to be rotatable. The middle cover 40 has teeth 5 circularly provided on the inner portion of the bottom surface thereof to be engaged with the gear coupling portion 2 and a central shaft 7 extending downward to be inserted into a central hole 6 of the reel 20. The stopper unit 50 is accommodated within the middle cover 40, and has shaft holes 8 in the bottom portion to be coupled to shafts 9 of the middle cover 40. The stopper unit 50 has stoppers 50*a* radially diverging from the outer surface to be elastic and matching ratchets 50*b* disposed on the stoppers 50*a* to be engaged with the main ratchet 4 of the housing, such that the main ratchet 4 is restrained to rotate in one direction. The upper rotatable cover 60 covers the top surface of the middle cover 40, and rotates integrally with the middle cover 40 due to locking members 11 coupled to the middle cover 40. A subratchet 70 is circularly provided on the entire top surface of the main ratchet 4 and rotates in the same direction as the main ratchet 4, horizontal plates 12 are connected to the top surfaces of the matching ratchets 50*b* of the stoppers 50*a* radially and elastically disposed on the stopper unit 50, and matching subratchets 70*a* are disposed on the bottom surfaces of the horizontal plates 12 to be selectively engaged with the subratchet 70 and rotate in the same direction as the subratchet 70, such that the matching subratchets 70*a* are not engaged with the subratchet 70 during rotation of the stopper unit 50 and are engaged with the subratchet 70 when stopped in a tightened position to provide dual restraining force.

In addition, the shaft holes 8 of stopper unit 50, to which the shafts 9 of the middle cover 40 are coupled, are in the shape of slits such that spaces S are defined between the shaft holes 8 and the shafts 9, so that the stopper unit 50 can move slightly in a lateral direction.

In addition, the lower cover 10 has one or more sewing guide grooves 13 formed along the peripheral portion thereof to guide accurate sewing.

In addition, the central shaft 7 of the middle cover 40, inserted into the central hole 6 of the reel 20 to be moved up and down, has flexibility due to a notch formed in the middle portion thereof. Locking protrusions 14 are circularly provided on the outer circumferential portion of the bottom end of the central shaft 7. The locking protrusions 14 may move up and down while being brought into contact with and being detached from locking projections 15 circularly provided on the central hole 6 of the reel 20, so that a connection and disconnection between the stopper unit 50 and the reel 20 can be indicated.

The wire tightening device according to the present invention having the above-described configuration is assembled as follows. First, the lower cover 10 is sewn to an upper of a shoe. The shoelace wire 3 is inserted into and bound to a withdrawal hole of the reel 20 by fitting the reel 20 into the receiving recess 1 of the lower cover 10, and then, the housing having the main ratchet is fixed to the lower cover 10 by fitting. The stopper unit 50 is seated on the top portion of the middle cover 40 by coupling of the shaft holes 8 and the shafts 9. The housing is covered with the middle cover 40 in an upwardly and downwardly movable manner, so that the central shaft 7 is inserted into the central hole 6 of the reel 20. After the stopper unit 50 is coupled to the middle cover 40 such that the matching ratchets 50*b*, provided on the outer surfaces of the stoppers of the stopper unit 50, are meshed with the main ratchet of the housing, the outer surface of the stopper unit 50 is covered with the upper rotatable cover 60, and the upper rotatable cover 60 is integrally coupled to the middle cover 40. In this manner, the process of attaching the wire tightening device to the shoe is completed in a simple manner.

Figure 4:
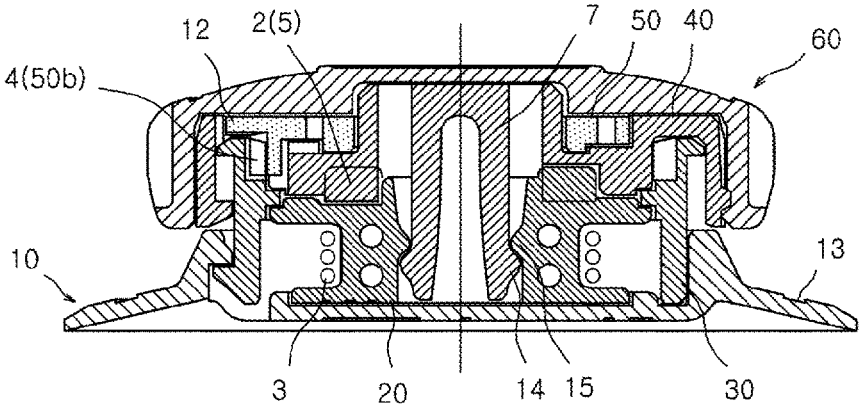
FIG. 4 is an assembled cross-sectional view of the meshed position of the stopper unit and the main ratchet according to the invention.
Figure 5:
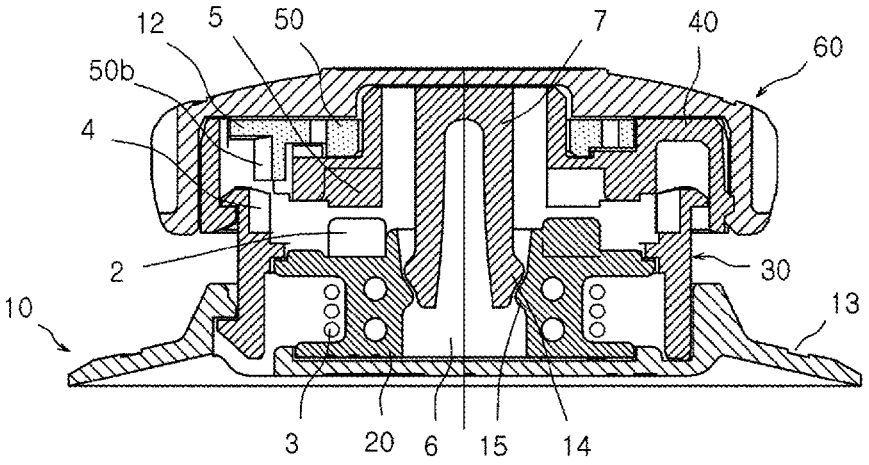
FIG. 5 is an assembled cross-sectional view of the disconnected position of the stopper unit and the main ratchet according to the invention.
Figure 6:
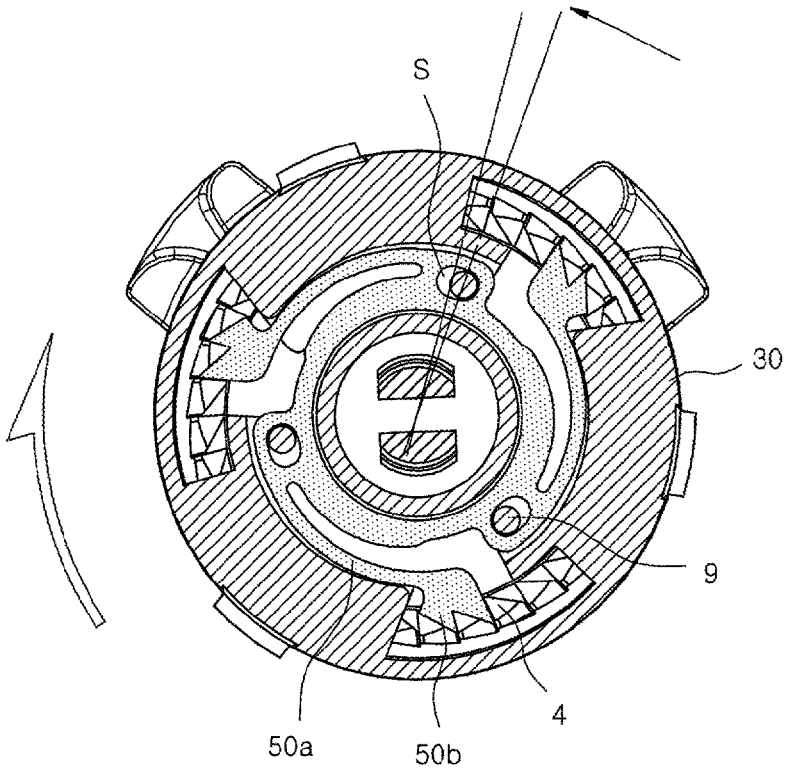
FIG. 6 is a plan view of the stopper unit and the middle cover coupled to each other.

Describing a general function of tightening and untightening a shoelace using the wire tightening device assembled as above, in response to upward or downward movement of the stopper unit 50 of the middle cover 40, the reel 20 is locked to or unlocked from the main ratchet 4, thereby causing the wire 3 to be wound or unwound, to which the upper rotatable cover 60 60 is coupled. When the wire is wound to tighten the shoelace, in a position in which the stoppers 50*a* of the stopper unit 50 are detached from the main ratchet 4 of the housing as illustrated in FIG. 5, the upper rotatable cover 60 may be pressed by an external force applied thereto. In response to the upper rotatable cover 60 being pressed, the central shaft 7 of the middle cover 40 integrally coupled to the upper rotatable cover 60 is moved downwards along the central hole 6 of the reel 20, so that the teeth 5 provided on the bottom surface engage with the gear coupling portion 2 provided on the top surface of the reel 20. In addition, the stopper unit 50 accommodated in the middle cover 40 also moves downwards, so that the matching ratchets 50*b* of the stoppers 50*a* rotate in one direction while remaining meshed with the main ratchet 4 provided on the inner circumferential portion of the housing (see FIG. 4).

When the upper rotatable cover 60 is rotated from this position, the matching ratchets 50*b* provided on the stoppers 50*a* of the middle cover 40 integrally coupled to the upper rotatable cover 60 rotate in one direction in engagement with the main ratchet 4 of the housing. In addition, due to the coupling between the middle cover 40, the gear coupling portion 2, and the teeth 5, the reel 20 is simultaneously rotated so that the wire 3 is wound on the reel 20. Here, the wire 3 remains in a restrained position so that the matching ratchets 50*b* of the stoppers 50*a* are meshed with the main ratchet 4 to rotate in one direction only.

Accordingly, when the upper rotatable cover 60 is rotated, the wire 3 can be continuously wound on the reel 20 to tighten the shoe. In the tightened position, even in the case in which the rotation of the upper rotatable cover 60 is stopped, the matching ratchets 50*b* of the stoppers 50*a* are engaged with the main ratchet 4 of the housing to restrain backward rotation, the tensed tightened position can be maintained instead of being untightened.

In contrast, in the case of attempting to loosen the wire 3 from the tensed tightened position in order to take off the shoe, the upper rotatable cover 60 is drawn upwards to upwardly move the stopper unit 50 that has been moved downwards to engage with and restrain the main ratchet 4. Then, the middle cover 40 integrally coupled to the upper rotatable cover 60 is simultaneously moved upwards, so that a portion of the central shaft 7 is also moved upwards from the central hole 6 of the reel 20. At the same time, the stopper unit 50 accommodated in the middle cover 40 is simultaneously moved upwards, so that the matching ratchets 50*b* of the stoppers 50*a* are detached from the main ratchet 4 to release the reel 20, which tends to rotate in one direction, from the restrained position. Consequently, the reel 20 can rotate freely, and when the wire 3 is drawn, the wire 3 can be unwound from the reel 20, thereby being loosened from the tightened position. Accordingly, the reel 20 can be selectively restrained and released in response to upward and downward movement of the stopper unit 50, as is disclosed in a variety of related-art solutions.

Figure 7:
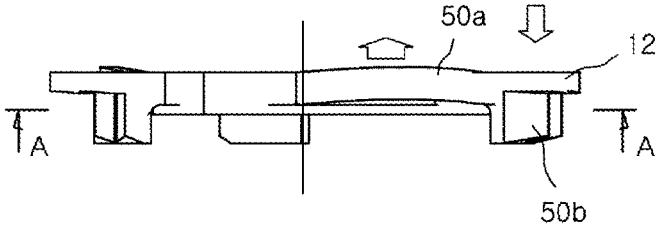
FIG. 7 is an enlarged view illustrating an upwardly curved position of the stopper of the stopper unit.
Figure 8:
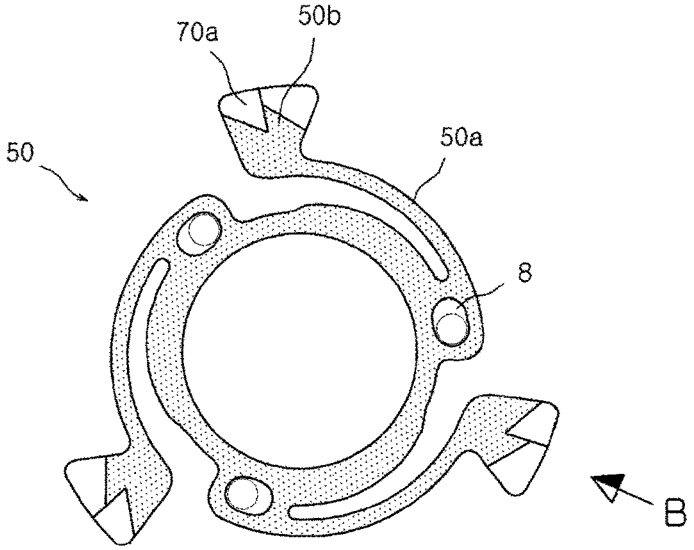
FIG. 8 is a bottom view taken along line "A-A" in FIG. 7.
Figure 9:
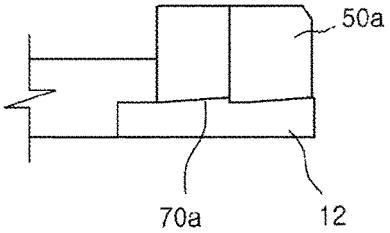
FIG. 9 is an enlarged view taken in direction "B" in FIG. 8.

During wearing the shoe, unwinding force, in addition to movement, is applied to the shoelace wound on the reel 20 and tightened in the tensed state. However, since the rotation of the reel 20 in one direction is restrained by the stoppers 50*a* of the stopper unit 50 meshed with the main ratchet 4, as described above, a large amount of load may be applied to the main ratchet 4 and the stoppers 50*a*, thereby causing the main ratchet 4 and the stoppers 50*a* to be easily abraded. Accordingly, when the shoe has been used for a long time, the restraining force of the stoppers 50*a* may be reduced, which is problematic. The present invention is intended to overcome the above-described problems. The present invention is characterized in that the subratchet 70 is circularly provided on the entire top surface of the main ratchet 4 and rotates in the same direction as the main ratchet 4, and the horizontal plates 12 are connected to the top surfaces of the matching ratchets 50*b* of the stoppers 50*a* radially and elastically disposed on the stopper unit 50, such that the matching subratchets 70*a* engaging with the subratchet 70 are provided on the bottom surfaces of the horizontal plates 12, so that load concentrated to the main ratchet 4 and the stoppers 50*a* is distributed. When the wire 3 is wound on the reel 20 by rotating the upper rotatable cover 60, disengagement is maintained so as not to provide restraining force, as illustrated in (A) of FIG. 10. In contrast, in a stop position tightened with an intended amount of tension, the stoppers 50*a* of the stopper unit 50 are subjected to load due to tension so that a middle portion thereof is upwardly curved so as to be slightly convex, as illustrated in FIG. 7.

Figure 10:
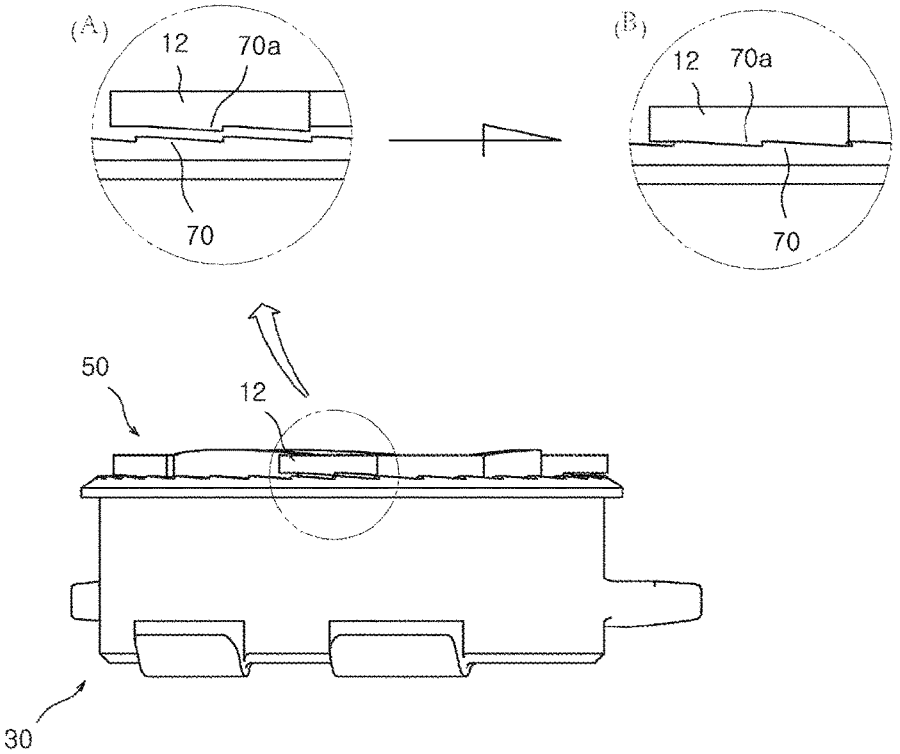
FIG. 10 is a schematic view disengaged and engaged positions of a subratchet and a matching subratchet.

When the stoppers 50*a* are upwardly curved in this manner, the distal ends of the stopper unit 50 accommodated in the limited space of the middle cover 40, i.e. the distal ends on which the matching subratchets 70*a* are provided, are slightly moved downwards to be engaged with the subratchet 70, horizontally provided on the top surface of the main ratchet 4, as illustrated in (B) of FIG. 10.

Accordingly, the stoppers 50*a*, meshed with the main ratchet 4 to provide restraining force, not only can provide dual restraining force due to the engagement of the subratchet 70 and the matching subratchets 70*a*, but also can distribute load concentrated to the main ratchet 4. This can reduce the abrasion of the main ratchet 4 and the stoppers 50*a*, thereby increasing the longevity thereof.

In addition, according to the present invention, the shaft holes 8 of the stopper unit 50, to which the shafts 9 of the middle cover 40 are coupled, are provided as slits with the spaces S being defined between the shaft holes 8 and the shafts 9. When the wire 3 is tightened, even in the case in which the stoppers 50*a* are located on some of the teeth of the main ratchet 4 in the process in which the stoppers 50*a* are meshed with the main ratchet 4 by being fitted into and exiting the notches between the teeth of the main ratchet 4, there is a length of time in which the stoppers 50*a* can be accurately meshed at appropriate positions due to the spaces S of the slits, instead of being meshed at positions slightly behind the appropriate positions, differently from related-art cases. Consequently, the stopper unit 50 can be meshed with a corresponding location of the main ratchet 4 while slightly moving in a lateral direction, so that the shoelace can be tightened with an intended strength of tightening force.

In other words, in a plurality of cases of the related art, when the wire 3 is tightened, the stoppers 50*a* may be located on some of the teeth of the main ratchet 4 in the process in which the stoppers 50*a* are meshed with the main ratchet 4 by being fitted into and exiting the notches between the teeth of the main ratchet 4, so that the stoppers 50*a* may be pushed backwards from appropriate locations of the main ratchet 4 and be meshed with other locations of the main ratchet 4 behind the appropriate locations. In such cases, an intended amount of tightening force may not be obtained one time. In addition, there is a problem in that the meshed state may be deteriorated due to the abrasion of the stoppers 50*a* and the main ratchet 4 meshed at the same locations when used for a long time. However, according to the present invention, this problem can be overcome by slight movement of the stopper unit 50.

In addition, the one or more sewing guide grooves 13 are provided along the peripheral portion of the lower cover 10 to guide accurate sewing. Accordingly, workers in shoe factories can accurately sew the tightening device to a shoe along the sewing lines, thereby obtaining a clean attachment state and improve the quality of products.

In addition, the central shaft 7 of the middle cover 40, inserted into the central hole 6 of the reel 20 to be moved up and down, has flexibility due to the notch formed in the middle portion thereof. The locking protrusions 14 are circularly provided on the outer circumferential portion of the bottom end of the central shaft 7. The locking protrusions 14 are configured to be brought into contact with and be detached from the locking projections 15 circularly provided on the central hole 6 of the reel 20, in a corresponding manner. When the locking protrusions 14, circularly provided on the bottom end of the central shaft 7, move up and down while being brought into contact with and being detached from the locking projections 15 circularly provided on the central hole 6 of the reel 20 in response to the upper rotatable cover 60 being moved up and down, elastic movement of the central shaft 7 due to the notch therefore may facilitate the upward and downward movement of the locking protrusions 14. In particular, when the locking protrusions 14 crossing the locking projections 15, sound may be generated and a sensation may be transferred to the user. Accordingly, it is possible to clearly and accurately connect and disconnect the stopper unit 50 and the reel 20.

As set forth above, according to the present invention, pressure and load concentrated to the main ratchet 4 are distributed, and the rotation of the reel 20 is restrained by dual-meshing the stoppers 50*a*. Accordingly, it is possible to more intensifying the tightening of the wire 3 and reduce the abrasion of the main ratchet 4 and the stoppers 50*a*, thereby improving the durability of the main ratchet 4 and the stoppers 50*a*. In addition, it is possible to obtain an intended level of tightening force.

What is claimed is:

1. A shoelace tightening device comprising:

a lower cover having a receiving recess within a top portion of the lower cover;

a reel rotatably inserted into the receiving recess of the lower cover wherein the reel comprises a gear coupling portion provided on a top portion of the reel such that a wire is wound on the reel when the reel is rotated;

a housing accommodating the reel inside the housing, wherein a bottom end portion of the housing is fixed to the receiving recess of the lower cover to be integrally fixed to the lower cover, the housing comprises a main ratchet provided along an inner circumferential portion of a top end portion of the housing;

a middle cover containing the housing inside the middle cover while being separated from the housing so as to be rotatable, wherein the middle cover comprises a plurality of teeth circularly provided on an inner portion of a bottom surface of the middle cover to be engaged with the gear coupling portion and a central shaft extending downward to be inserted into a central hole of the reel;

a stopper unit accommodated within the middle cover, wherein the stopper unit comprises a plurality of shaft holes in a bottom portion to be coupled to a plurality of shafts of the middle cover, a plurality of stoppers radially diverge from an outer surface of the stopper unit to be elastic, and a plurality of matching ratchets are disposed on the plurality of stoppers to be engaged with the main ratchet of the housing, such that the main ratchet is restrained to rotate in one direction; and an upper rotatable cover covering a top surface of the middle cover, and rotating integrally with the middle cover due to a plurality of locking members coupled to the middle cover, wherein a subratchet is circularly provided on an entire top surface of the main ratchet and rotates in a same direction as the main ratchet, a plurality of horizontal plates are connected to top surfaces of the plurality of matching ratchets of the plurality of stoppers radially and elastically disposed on the stopper unit, and a plurality of matching subratchets are disposed on bottom surfaces of the plurality of horizontal plates to be selectively engaged with the subratchet and rotate in the same direction as the subratchet, such that the plurality of matching subratchets are not engaged with the subratchet during a rotation of the stopper unit and are engaged with the subratchet when stopped in a tightened position to provide a dual restraining force.

2. The shoelace tightening device according to claim 1, wherein the plurality of shaft holes of the stopper unit are coupled to the plurality of shafts of the middle cover, and the plurality of shaft holes are in a shape of slits such that spaces are defined between the plurality of shaft holes and the plurality of shafts, so that the stopper unit is movable slightly in a lateral direction.

3. The shoelace tightening device according to claim 1, wherein the central shaft, inserted into the central hole of the reel to be moved up and down has a flexibility due to a notch formed in a middle portion of the central shaft, and a plurality of locking protrusions are circularly provided on an outer circumferential portion of a bottom end of the central shaft, the plurality of locking protrusions are movable up and down while being brought into contact with and being detached from locking projections circularly provided on the central hole of the reel, so that an indication of a connection and a disconnection between the stopper unit and the reel is possible.

4. The shoelace tightening device according to claim 1, wherein the lower cover comprises one or more sewing guide grooves provided along a peripheral portion of the lower cover to guide an accurate sewing.

* * * * *